US007597569B2

(12) United States Patent
Okuda et al.

(10) Patent No.: US 7,597,569 B2
(45) Date of Patent: Oct. 6, 2009

(54) COMBINATION OF LEVER CONNECTOR AND MATING CONNECTOR

(75) Inventors: Katsumasa Okuda, Tokyo (JP); Satoru Majima, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/070,462

(22) Filed: Feb. 19, 2008

(65) Prior Publication Data

US 2008/0200052 A1 Aug. 21, 2008

(30) Foreign Application Priority Data

Feb. 19, 2007 (JP) ..... 2007-038180

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS 5,829,994 A 11/1998 Oda et al.

(Continued)

FOREIGN PATENT DOCUMENTS

EP 1 887 664 2/2008

(Continued)

OTHER PUBLICATIONS

British Combined Search and Examination Report dated Jun. 11, 2008.

(Continued)

*Primary Examiner*—Tho D Ta
*Assistant Examiner*—Travis Chambers
(74) *Attorney, Agent, or Firm*—Collard & Roe, P.C.

(57) ABSTRACT

A combination of first and second connectors fittable with and detachable from each other is disclosed. The first connector comprises a first body, a guided portion and a stopper-releaser. The guided portion is held by the first body and is movable between a detachment position and a fit position via a preliminary-fit position when the first connector is fitted with or detached from the second connector. The fit position and the preliminary-fit position are within the second connector. The stopper-releaser accompanies the guided portion. The second connector comprises a second body, a lever and a lever stopper. The lever is provided with a guiding portion and is supported by the second body so that the lever is rotatable between first and second positions. The lever allows the guided portion to move between the detachment position and the preliminary-fit position when the lever is positioned at the first position. The guiding portion guides the guided portion to the fit position when the lever is rotated from the first position to the second position after the guided portion is positioned at the preliminary-fit position. The guiding portion guides the guided portion to the preliminary-fit position when the lever is rotated from the second position to the first position after the first connector is fitted with the second connector. The lever stopper stops rotation of the lever from the first position toward the second position when the lever is positioned at the first position. The stopping of the rotation is released by the stopper-releaser upon the guided portion is moved from the preliminary position toward the fit position.

8 Claims, 5 Drawing Sheets

U.S. PATENT DOCUMENTS

| | | | | |
|---|---|---|---|---|
| 6,099,330 | A * | 8/2000 | Gundermann et al. | 439/157 |
| 6,341,968 | B1 | 1/2002 | Grant | |
| 6,733,313 | B2 | 5/2004 | Shinozaki et al. | |
| 6,854,992 | B2 * | 2/2005 | Martin et al. | 439/157 |
| 6,863,551 | B2 * | 3/2005 | Fukamachi | 439/157 |
| 2002/0177338 | A1 | 11/2002 | Nishide et al. | |

FOREIGN PATENT DOCUMENTS

| | | |
|---|---|---|
| JP | 63-99788 | 6/1988 |
| JP | 9-204956 | 8/1997 |
| JP | 11-185872 | 7/1999 |
| JP | 2000-57559 | 12/2000 |
| JP | 2003-223955 | 8/2003 |
| JP | 2004-164933 | 6/2004 |

OTHER PUBLICATIONS

Japanese Office Action dated Dec. 4, 2008, with English translation.

* cited by examiner

COMBINATION OF LEVER CONNECTOR AND MATING CONNECTOR

BACKGROUND OF THE INVENTION

This invention relates to a combination of a lever connector and its mating connector.

The connector combination of this type is disclosed in U.S. Pat. No. 6,733,313 or JP A H11-185872, both of which are incorporated herein by reference in their entireties. The conventional connector combinations are designed without consideration of a smooth refit operation after detachment of the connectors. Therefore, there is a need for a connector combination that ensures a smooth refit operation.

SUMMARY OF THE INVENTION

One aspect of the present invention provides a combination of first and second connectors fittable with and detachable from each other. The first connector comprises a first body, a guided portion and a stopper-releaser. The guided portion is held by the first body and is movable between a detachment position and a fit position via a preliminary-fit position when the first connector is fitted with or detached from the second connector. The fit position and the preliminary-fit position are within the second connector. The stopper-releaser accompanies the guided portion. The second connector comprises a second body, a lever and a lever stopper. The lever is provided with a guiding portion and is supported by the second body so that the lever is rotatable between first and second positions. The lever allows the guided portion to move between the detachment position and the preliminary-fit position when the lever is positioned at the first position. The guiding portion guides the guided portion to the fit position when the lever is rotated from the first position to the second position after the guided portion is positioned at the preliminary-fit position. The guiding portion guides the guided portion to the preliminary-fit position when the lever is rotated from the second position to the first position after the first connector is fitted with the second connector. The lever stopper stops rotation of the lever from the first position toward the second position when the lever is positioned at the first position. The stopping of the rotation is released by the stopper-releaser upon the guided portion is moved from the preliminary position toward the fit position.

An appreciation of the objectives of the present invention and a more complete understanding of its structure may be had by studying the following description of the preferred embodiment and by referring to the accompanying drawings.

Figure 1:
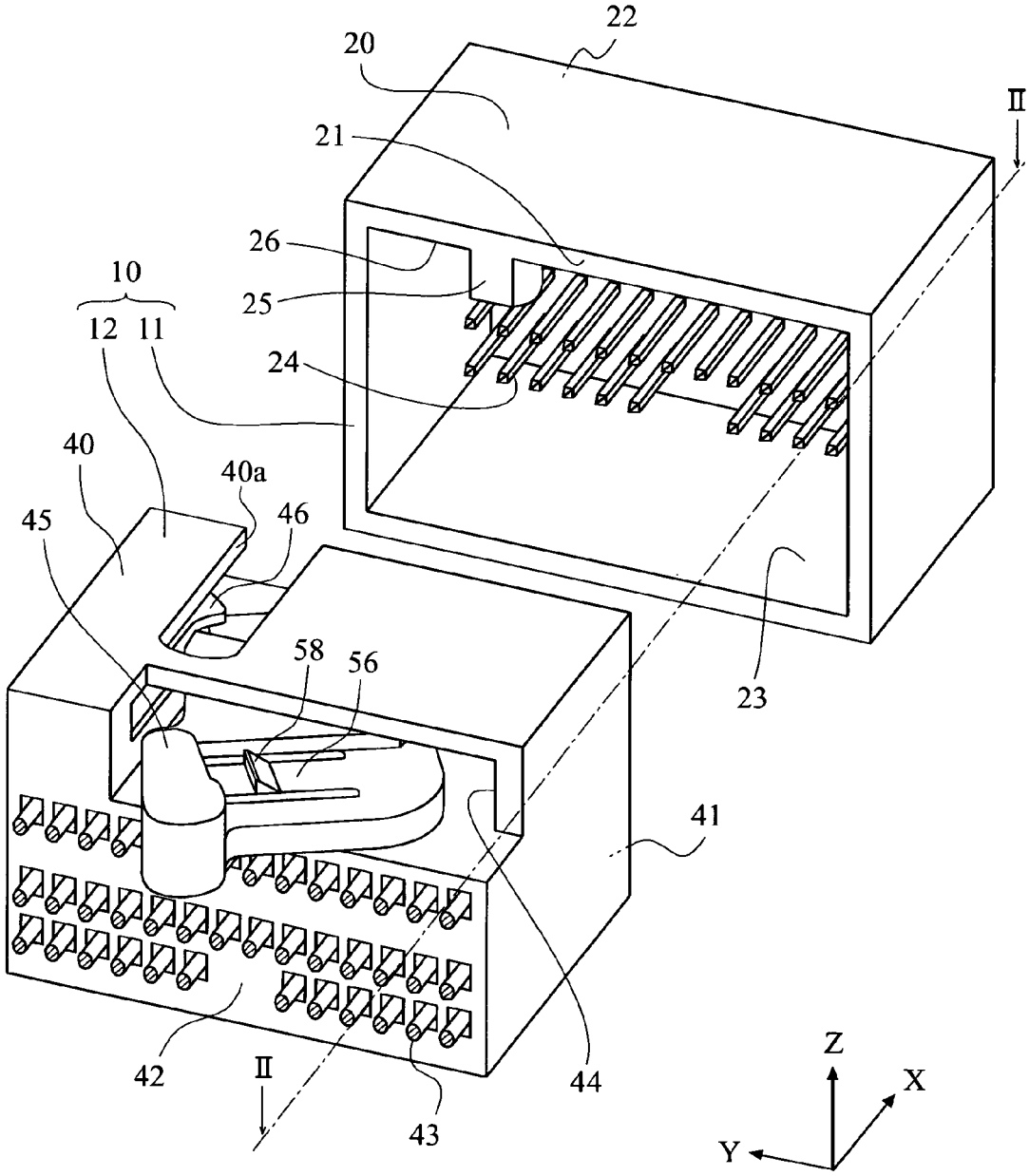
FIG. 1 is a perspective view schematically showing a combination of a lever connector and a mating connector in accordance with an embodiment of the present invention, wherein the lever connector and the mating connector are detached from each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

With reference to FIGS. 1 to 4, a combination 10 according to an embodiment of the present invention comprises a mating connector 11 and a lever connector 12, which is fittable with and detachable from the mating connector 11 along an X-direction.

As shown in FIG. 1, the mating connector 11 comprises a housing 20 and a plurality of male contacts 24.

As shown in FIGS. 1 to 4, the housing 20 has a front end portion 21 and a back end portion 22. Note that the male contacts 24 are omitted from the drawings for the sake of simplifying the description. The housing 20 defines an inner space 23 therein. The front end portion 21 is formed with an opening so that the inner space 23 can be seen through the opening of the front end portion 21 along the X-direction. Upon fitting the mating connector 11 with the lever connector 12, the lever connector 12 is inserted into the housing 20 through the opening of the front end portion 21 so that a part of the lever connector 12 is accommodated within the inner space 23 of the housing 20.

The back end portion 22 of the housing 20 holds the male contacts 24. Each of the male contacts 24 has two parts: front part and back part. The front part of the male contact 24 extends from the back end portion 22 toward the front end portion 21 along the X direction so that its front end is positioned within the inner space 23. The back part of the male contact 24 has an L shape and extends from the back end portion 22 outside the housing 20 to be connected with a substrate (not shown) on which the mating connector 11 is to be mounted. The male contacts 24 are arranged in a plurality of rows and columns.

As shown in FIGS. 1 to 4, the mating connector 11 of this embodiment further comprises a guided portion 25. The illustrated guided portion 25 is formed on an upper inner surface 26 of the housing 20 at the front end portion 21 and protrudes towards the inside of the housing 20 along a Z-direction perpendicular to the X-direction. In other words, the guided portion 25 protrudes downwardly within the inner space 23. The guided portion 25 is fixed to the housing 20 so that the guided portion 25 moves together with the housing 20. The guided portion 25 of this embodiment is formed integral with the housing 20.

Figure 2:
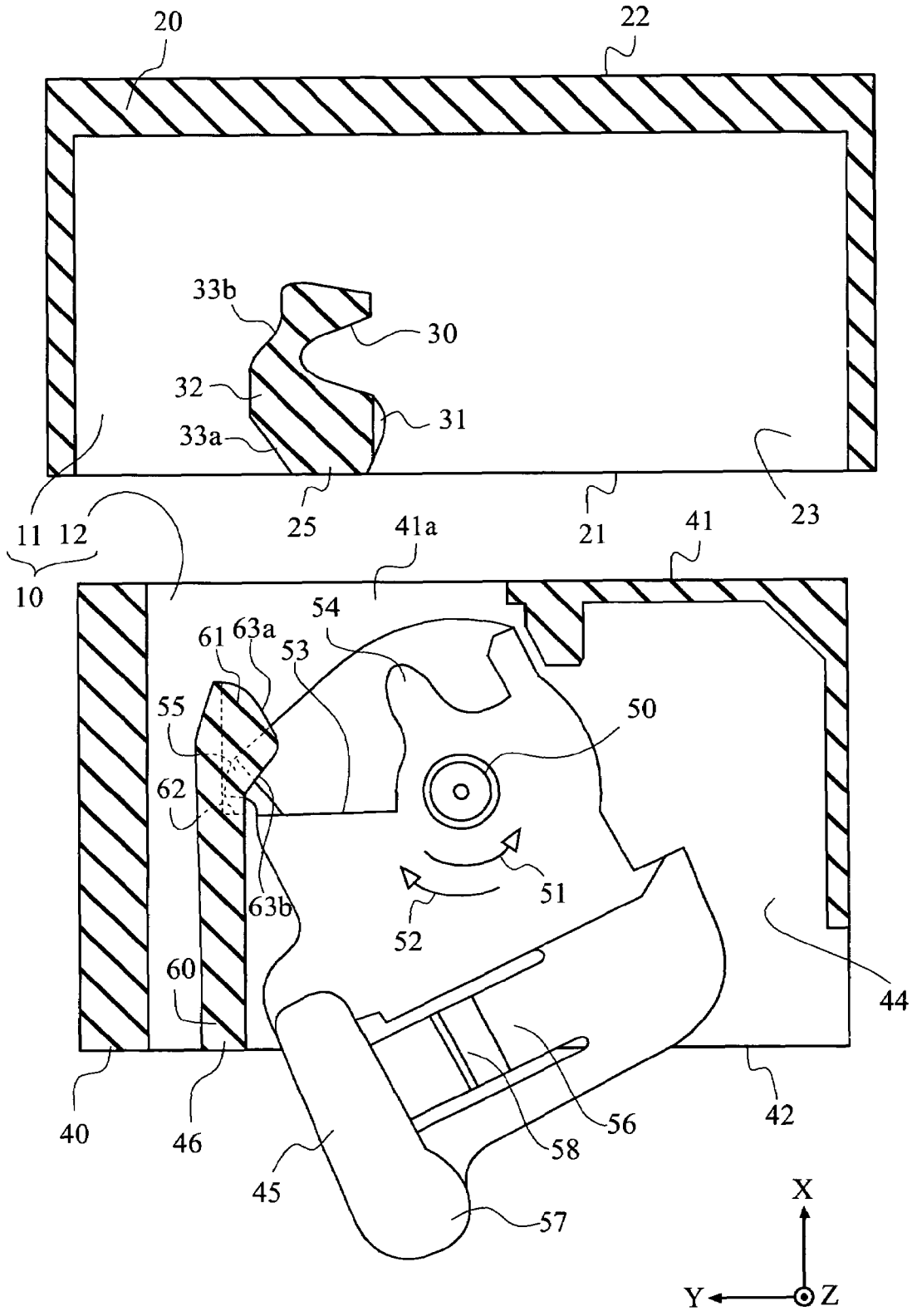
FIG. 2 is a cross-sectional view schematically showing the combination of FIG. 1, taken along lines II-II.
Figure 3:
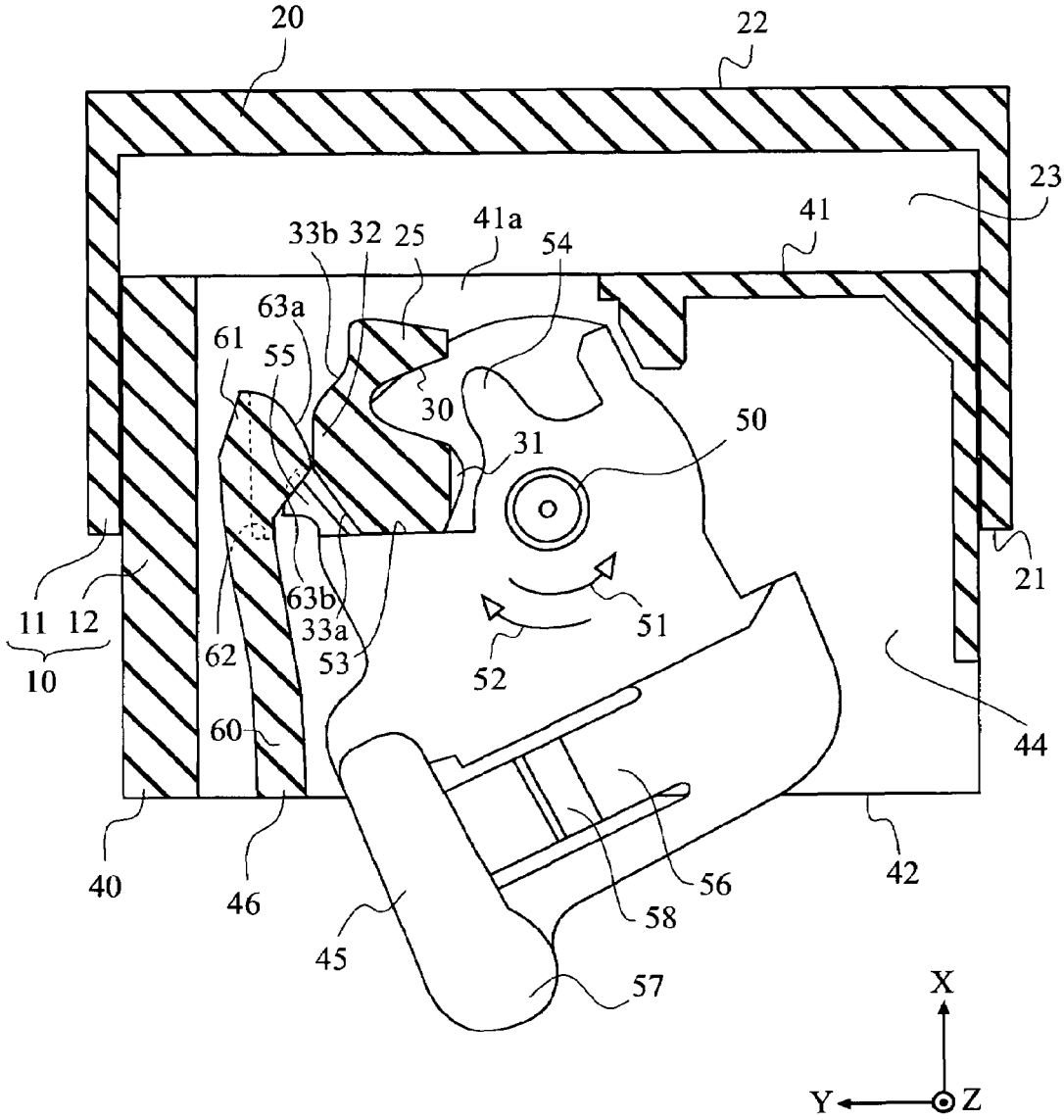
FIG. 3 is a cross-sectional view schematically showing the combination of FIG. 2, wherein the combination is in a preliminary-fit state.
Figure 4:
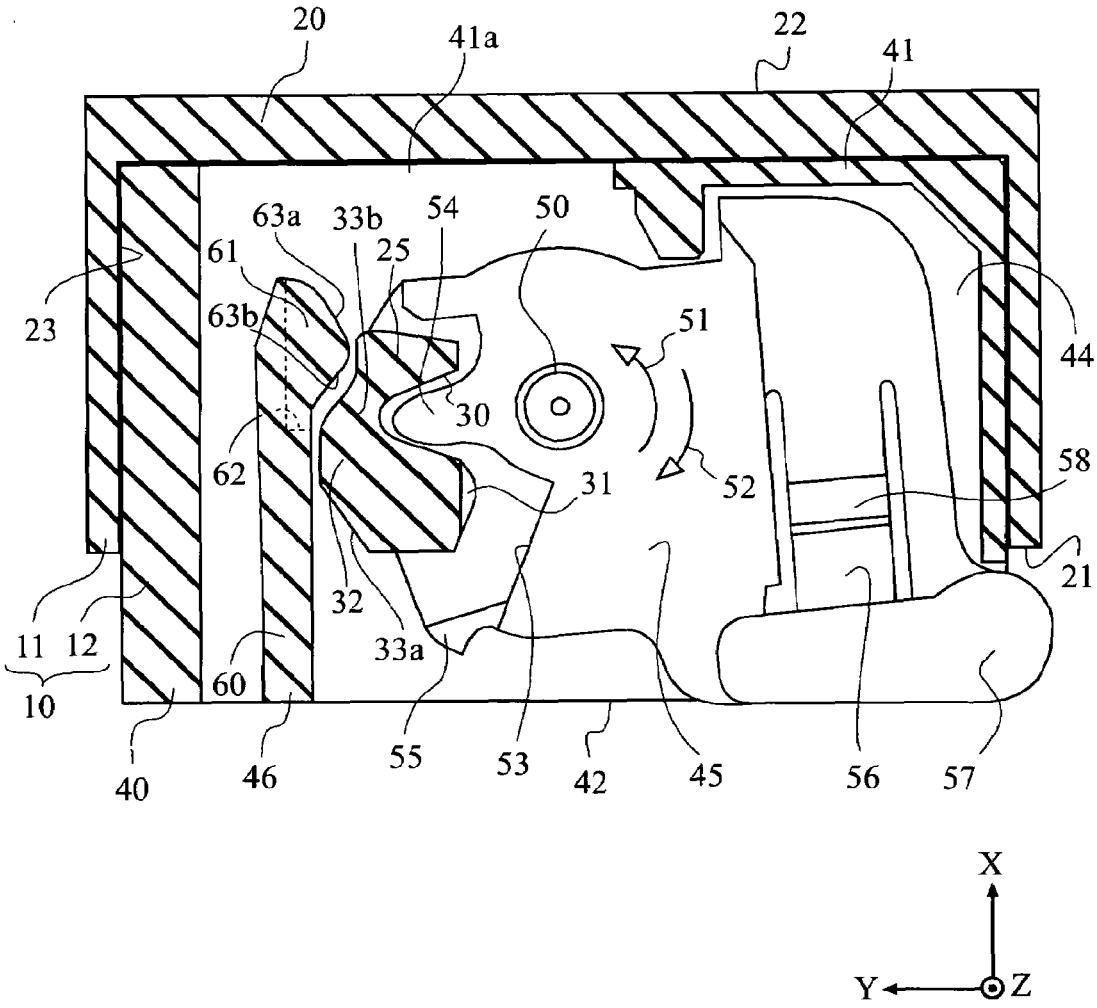
FIG. 4 is a cross-sectional view schematically showing the combination of FIG. 2, wherein the combination is in a fit state.
Figure 5:
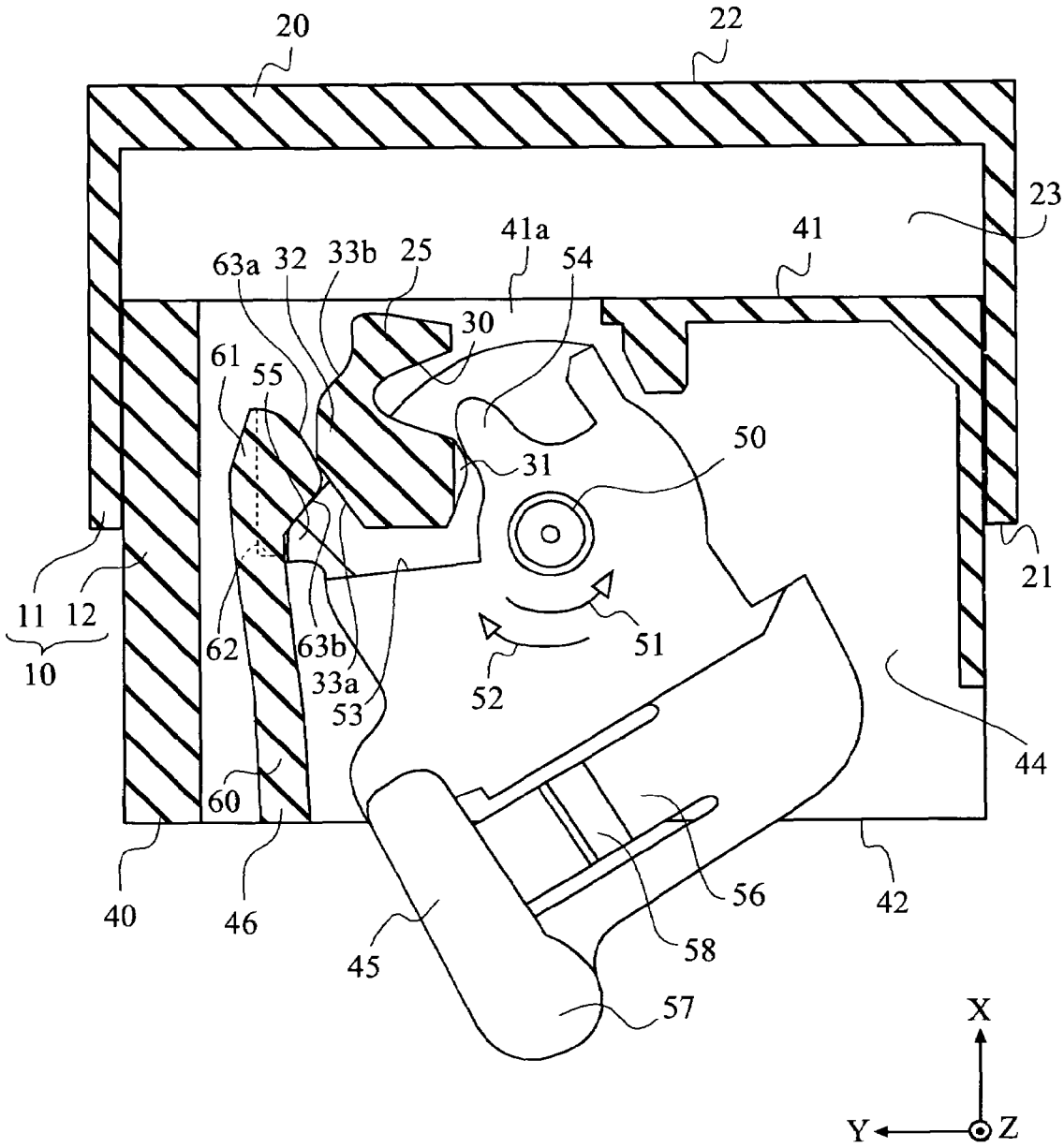
FIG. 5 is a cross-sectional view schematically showing the combination of FIG. 2, wherein the combination is in yet another state.

As shown in FIGS. 2 to 4, the illustrated guided portion 25 has two sides or side walls in a Y-direction perpendicular to the X- and the Z-directions. The guided portion 25 is formed with a depression 30, a position adjustment portion 31, and a stopper-releaser 32. The depression 30 and the position adjustment portion 31 are formed on one side of the guided portion 25, while the stopper-releaser 32 is formed on the other side of the guided portion 25. The depression 30 is depressed along the Y-direction. The position adjustment portion 31 is positioned between the depression 30 and the front end portion 21 and protrudes along the X-direction. The stopper-releaser 32 protrudes along the Y direction. The stopper-releaser 32 has pressing surfaces 33*a* and 33*b*, each of which extends oblique to the X- and the Y-directions.

In this embodiment, the depression 30, the lever pressing portion 31 and the stopper-releaser 32 are integrally formed, as explained above. However, these portions may be formed separately.

The guided portion 25 moves together with the housing 20 between a detachment position and a fit position via a preliminary-fit position when the mating connector 11 is fitted with and detached from the lever connector 12. In detail, when the guided portion 25 is positioned at the detachment position, the mating connector 11 is completely detached from the lever connector, as shown in FIG. 2. As apparent from FIG. 2, the detachment position of the guided portion 25 is outside the lever connector 12. When the guided portion 25 is positioned at the fit position, the mating connector 11 is completely fitted with the lever connector 12, as shown in FIG. 4. As apparent from FIG. 4, the fit position is inside the lever connector 12. The preliminary-fit position is also inside the lever connector 12. However, the mating connector 11 and the lever connector 12 are not completely fitted when the guided portion 25 is positioned at the preliminary-fit position, as shown in FIG. 3.

Next explanation will be made about the lever connector 12 with references to FIGS. 1 to 4.

The lever connector 12 comprises a housing 40, a plurality of female contacts 43, a lever 45, and a lever stopper 46.

The housing 40 is designed so that a part of the housing 40 is fittable within the inner space 23 of the housing 20 when the lever connector 12 is fitted with the mating connector 11. The housing 40 has a front end portion 41 and a back end portion 42. Upon fitting the lever connector 12 with the mating connector 11, the front end portion 41 is inserted into the housing 20 and the back end portion 42 remains outside the housing 20.

As shown in FIGS. 1 to 4, the housing 40 is formed with a lever accommodation portion 44. As shown in FIG. 1, the housing 40 is also formed with a slot 40*a* that communicates with the lever accommodation portion 44 along the Z-direction. As shown in FIG. 2, the front end portion 41 is formed with a front opening 41*a*, through which the lever accommodation portion 44 can be seen along the X-direction. Upon fitting the lever connector 12 with the mating connector 11, the guided portion 25 is inserted through the front opening 41*a* and is guided along the slot 40*a* into the lever accommodation portion 44.

As shown in FIGS. 2 to 4, the housing 40 is provided with a spindle 50. The spindle 50 is positioned within the lever accommodation portion 44 and extends along the Z-direction.

As shown in FIG. 1, the female contacts 43 are held by the housing 40 to extend along the X-direction. The female contacts 43 are arranged so that the female contacts 43 are connected with the respective male contacts 24 when the lever connector 12 is fitted with the mating connector 11.

The lever 45 according to this embodiment is accommodated within the lever accommodation portion 44 and is rotatably supported by the spindle 50. The spindle 50 serves as a rotation axis of the lever 45.

The rotation range of the lever 45 is between first and second positions. When the lever 45 is positioned at the first position, the guided portion 25 is positioned at the detachment position, as shown in FIG. 2. Note here that the guided portion 25 is allowed to be also positioned at the preliminary-fit position when the lever 45 is positioned at the first position, as shown in FIG. 3. In other words, the lever 45 allows the guided portion 25 to move between the detachment position and the preliminary-fit position. When the lever 45 is positioned at the second position, the guided portion 25 is positioned at the fit position, as shown in FIG. 4.

As shown in FIGS. 2 to 4, the lever 45 is rotatable in two rotational directions: fitting direction 51 and detaching direction 52. The lever 45 is rotated from the first position to the second position along the fitting direction 51 upon fitting of the lever connector 12 to the mating connector 11. The lever 45 is rotated from the second position to the first position along the detaching direction 52 upon detachment of the mating connector 11 from the lever connector 12.

The lever 45 has a guiding portion 54, a reception portion 53, a radial projection 55, an arm 56, and a handle 57.

The guiding portion 54 is a projection projecting in a radial direction perpendicular to the rotation axis. The guide portion 54 and the guided portion 25 operate in a manner similar to the so-called "pinion-and-rack" mechanism and transmit the rotation of the lever 45 into the linear movement of the guided portion 25. In this embodiment, the lever 45 is designed so that, when the lever 45 is positioned at the first position, the guiding portion 54 does not obstruct the linear movement of the guided portion 25 between the detachment position and the preliminary-fit position, as understood from FIGS. 2 and 3.

As apparent from FIG. 2, when the lever 45 is in the first position, the reception portion 53 faces forwards and can be seen through the front opening 41*a*. The reception portion 53 temporally receives the guided portion 25 during the fitting of the lever connector 12 to the mating connector 11 and adjusts the positional relation between the guided portion 25 and the guiding portion 54. The position adjustment by the reception portion 53 results in that, when the lever 45 is rotated in the fitting direction 51, the guiding portion 54 is engaged with the guided portion 25, in this embodiment.

As shown in FIGS. 2 to 4, the radial projection 55 projects in the radial direction. The illustrated radial projection 55 has a portion that is parallel to the YZ plane when the lever 45 is positioned at the first position, as shown in FIG. 2. In this embodiment, the lever 45 is designed so that the radial projection 55 is positioned outside of the guided portion 25 in the radial direction when the guided portion 25 is positioned at the preliminary-fit position. In other words, when the guided portion 25 is positioned at the preliminary-fit position, the guided portion 25 is positioned between the radial projection 55 and the spindle 50 in the radial direction.

The arm 56 is provided with a protrusion 58 protruding in the Z-direction, i.e. an axial direction of the spindle 50 in this embodiment. When the lever 45 is in the second position, the protrusion 58 is engaged with an engagement (not shown) of the housing 40 so that the lever 45 is locked and is prevented from undesirably rotating in the detaching direction 52. When the protrusion 58 is released from the engagement of the housing 40, the lever 45 can be rotated in the detaching direction, again.

As shown in FIG. 2, the illustrated handle 57 projects outwardly of the back end portion 42 when the lever 45 is in the first position. Therefore, the lever 45 can be easily operated upon the fitting operation.

The lever stopper 46 according to this embodiment has a shape extending along the X-direction and comprises a supported portion 60, a free end 61, and a stopper portion 62. The supported portion 60 is supported by the back end portion 42 of the housing 40. The lever stopper 46 is bendable, and the free end 61 is movable in the Y-direction.

The free end 61 also protrudes toward the spindle 50 in the Y-direction. In this embodiment, the free end 61 is formed with pressed end portions 63*a* and 63*b*, each of which extend oblique to the X- and the Y-directions. The lever stopper 46 is designed and arranged so that the guided portion 25 is brought into contact with the free end 61 upon the fitting/the detachment process. In detail, upon the fitting process, the pressing surface 33*a* is brought into contact with the pressed end portion 63*a* and presses the pressed end portion 63*a* so that the lever stopper 46 is bent. On the other hand, upon the detachment process, the pressing surface 33*b* is brought into contact with the pressed end portion 63*b* and presses the pressed end portion 63*b* so that the lever stopper 46 is bent.

The stopper portion 62 is formed beneath the pressed end portions 63*a* and 63*b* and, when the lever stopper 46 is in its initial state as shown in FIG. 2, is parallel to the YZ plane. The lever stopper 46 is designed so that, when the lever 45 is in the first position, the stopper portion 62 can receive the radial projection 55 in the X-direction to stop the rotation of the lever 45 in the fitting direction 51, as shown in FIG. 2.

Next description will be made about the fitting process of the mating connector 11 with the lever connector 12.

As shown in FIG. 3, the front end portion 41 of the lever connector 12 is partly inserted into the inner space 23 of the mating connector 11 through the opening of the front end portion 21.

By the insertion of the lever connector 12 into the inner space 23 of the mating connector 11, the guided portion 25 is brought into contact with the reception portion 53 at the preliminary-fit position. The stopper-releaser 32 moves into the lever connector 12 accompanying the guided portion 25 so that the pressing surface 33*a* of the stopper-releaser 32 presses the pressed end portion 63*a* in the Y-direction. As the result, the lever stopper 46 is bent so that the free end 61 goes apart from the lever 45. Thus, the stopping of the rotation of the lever 45 in the fitting direction 51 is released.

As the lever 45 is rotated in the fitting direction 51, the guiding portion 54 moves into the depression 30 and pulls the guided portion 25 in the X-direction toward the back end portion 42 of the lever connector 12. In the meantime, the stopper-releaser 32 passes the free end 61 so that the lever stopper 46 returns to its initial state. When the lever 45 is positioned at the second position as a result of further rotation, the guided portion 25 is completely engaged with the guiding portion 54 and is positioned at the fit position so that the lever connector 12 is fitted into the mating connector 11, as shown in FIG. 4. The fitting state is locked by the protrusion 58 and the engagement (not shown) of the housing 40.

Next, description will be made about the detachment process of the mating connector 11 from the lever connector 12.

After the arm 56 is pressed downward to release the protrusion 58 from the housing 40, the lever 45 is rotated from the second position toward the first position in the detaching direction 52 so that the guiding portion 54 presses the depression 30 toward the front end portion 41 in the X-direction. Accordingly, the guided portion 25 moves from the fit position towards the detachment position.

As the lever 45 is rotated in the detaching direction 52, the pressing surface 33*b* is brought into contact with the pressed end portion 63*b* and presses the pressed end portion 63*b* in the Y-direction so that the free end 61 moves in the Y-direction apart from the lever 45. When the lever 45 is further rotated to the first position, the radial projection 55 moves so that the radial projection 55 is positioned between the front end portion 41 and the stopper portion 62 in the X direction.

The mating connector 11 can be easily detached from the lever connector 12 when the engagement of the guiding portion 54 with the guided portion 25 is released. Upon the mating connector 11 is detached from the lever connector 12, the guided portion 25 also moves together with the mating connector 11 so that the stopper-releaser 32 passes the free end 61 of the lever stopper 46. As the result, the lever stopper 46 returns back to its initial state. The lever stopper 46 of the initial state prevents the lever 45 from rotating in the fitting direction 51 and keeps the lever 45 at the first position. Therefore, upon refitting of the mating connector 11 with the lever connector 12, the guided portion 25 can easily moves to the preliminary-fit position.

Note here that the mating connector 11 of this embodiment comprises the position adjustment portion 31. If the radial projection 55 is not positioned between the front end portion 41 and the stopper portion 62 when the lever stopper 46 returns to the initial state, the stopper portion 62 cannot receive the radial projection 55 of the lever 45. In this case, because the guiding portion 54 obstructs the linear movement of the guided portion 25, the mating connector 11 and the lever connector 12 fail in their refit operation. However, when the guided portion 25 goes out of the lever connector 12, the position adjustment portion 31 of this embodiment adjusts the position of the guiding portion 54, accordingly the position of the radial projection 55 so that the radial projection 55 is positioned between the front end portion 41 and the stopper portion 62. In other words, when the mating connector 11 is detached from the lever connector 12, the position adjustment portion 31 adjusts positions of the lever stopper 46 and the lever 45 so that the radial projection 55 is positioned between the front end portion 41 and the stopper portion 62. Therefore, it is assured that the lever stopper 46 keeps the lever 45 at the first position and stop the rotation of the lever.

The present application is based on a Japanese patent application of JP2007-038180 filed before the Japan Patent Office on Feb. 19, 2007, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A combination of first and second connectors fittable with and detachable from each other, the first connector comprising a first body, a guided portion and a stopper-releaser, the guided portion being held by the first body and being movable between a detachment position and a fit position via a preliminary-fit position when the first connector is fitted with or detached from the second connector, the fit position and the preliminary-fit position being within the second connector, the stopper-releaser accompanying the guided portion, the second connector comprising a second body, a lever and a lever stopper, the lever being provided with a guiding portion, the lever being supported by the second body so that the lever is rotatable between first and second positions, the lever allowing the guided portion to move between the detachment position and the preliminary-fit position when the lever is positioned at the first position, the guiding portion guiding the guided portion to the fit position when the lever is rotated from the first position to the second position after the guided portion is positioned at the preliminary-fit position, the guiding portion guiding the guided portion to the preliminary-fit position when the lever is rotated from the second position to the first position after the first connector is fitted with the second connector, the lever stopper stopping rotation of the lever from the first position toward the second position when the lever is positioned at the first position, the stopping of the rotation being released by the stopper-releaser upon the guided portion is positioned at the preliminary-fit position;

wherein the lever stopper is held by the second body so that the lever stopper is elastically bendable, the stopper-releaser bending the lever stopper to release the stopping of the rotation.

2. The combination according to claim 1, wherein the guided portion and the stopper-releaser are formed integrally with each other.

3. The combination according to claim 1, wherein the first connector further comprises a position adjustment portion that, when the first connector is detached from the second connector, adjusts positions of the lever stopper and the lever so that the lever stopper can surely stop the rotation of the lever.

4. The combination according to claim 1, wherein the guided portion and the guiding portion are engaged with each other when the guiding portion guides the guided portion to the fit position.

5. The combination according to claim 4, wherein the lever is rotatable around an axis, the guiding portion comprising a projection projecting along a radial direction perpendicular to the axis, the first and the second connectors being fittable and detachable along a first direction, the guided portion being formed with a depression that is depressed towards a second direction perpendicular to the first direction, the projection being engaged with the depression upon the fitting of the first connector with the second connector.

6. The combination according to claim 1, wherein the first and the second connectors are fittable and detachable along a first direction, the lever stopper being held by the second body so that the lever stopper extends along the first direction when the lever is positioned at the first position, the stopper-releaser pressing the lever stopper towards a second direction perpendicular to the first direction when releasing the stopping of the rotation.

7. The combination according to claim 6, wherein the lever stopper is formed with a free end, the free end being formed with a pressed edge extending in a direction oblique to the first and the second directions, the stopper-releaser being formed with a press end portion that is oblique to the first and the second directions and presses the pressed edge of the free end of the lever stopper along the second direction when the first connector is fitted with the second connector along the first direction.

8. A combination of first and second connectors fittable with and detachable from each other, the first connector comprising a first body, a guided portion and a stopper-releaser, the guided portion being held by the first body and being movable between a detachment position and a fit position via a preliminary-fit position when the first connector is fitted with or detached from the second connector, the fit position and the preliminary-fit position being within the second connector, the stopper-releaser accompanying the guided portion, the second connector comprising a second body, a lever and a lever stopper, the lever being provided with a guiding portion, the lever being supported by the second body so that the lever is rotatable between first and second positions, the lever allowing the guided portion to move between the detachment position and the preliminary-fit position when the lever is positioned at the first position, the guiding portion guiding the guided portion to the fit position when the lever is rotated from the first position to the second position after the guided portion is positioned at the preliminary-fit position, the guiding portion guiding the guided portion to the preliminary-fit position when the lever is rotated from the second position to the first position after the first connector is fitted with the second connector, the lever stopper stopping rotation of the lever from the first position toward the second position when the lever is positioned at the first position, the stopping of the rotation being released by the stopper-releaser upon the guided portion is positioned at the preliminary-fit position;

wherein the first connector further comprises a position adjustment portion that, when the first connector is detached from the second connector, adjusts positions of the lever stopper and the lever so that the lever stopper can surely stop the rotation of the lever; and wherein the position adjustment portion is formed integrally with the guided portion.

* * * * *